US006638109B2

(12) United States Patent
Kurimoto et al.

(10) Patent No.: US 6,638,109 B2
(45) Date of Patent: Oct. 28, 2003

(54) CONNECTOR WITH A SIDE RETAINER

(75) Inventors: Naoya Kurimoto, Yokkaichi (JP); Kazuhiko Nimura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/145,662

(22) Filed: May 14, 2002

(65) Prior Publication Data

US 2002/0187676 A1 Dec. 12, 2002

(30) Foreign Application Priority Data

Jun. 6, 2001 (JP) ..... 2001-171366

(51) Int. Cl.[7] ..... H01R 9/05; H01R 13/514
(52) U.S. Cl. ..... 439/595; 439/752
(58) Field of Search ..... 439/595, 752, 439/489

(56) References Cited

U.S. PATENT DOCUMENTS

| | | | | |
|---|---|---|---|---|
| 5,167,534 A | | 12/1992 | Ohsumi | |
| 5,203,722 A | | 4/1993 | Kinoshita | 439/595 |
| 5,437,565 A | * | 8/1995 | Atsumi et al. | 439/752 |
| 5,692,929 A | | 12/1997 | Hoffmann | 439/752 |
| 5,782,657 A | | 7/1998 | Wolla et al. | |
| 5,797,772 A | * | 8/1998 | Sakurai et al. | 439/752 |
| 5,913,697 A | | 6/1999 | Myer et al. | |
| 6,193,551 B1 | | 2/2001 | Yamamoto et al. | |
| 6,361,378 B1 | * | 3/2002 | Konoya et al. | 439/752 |
| 2002/0127913 A1 | * | 9/2002 | Ichio | 439/595 |

FOREIGN PATENT DOCUMENTS

| | | |
|---|---|---|
| JP | 1-177877 | 12/1989 |
| JP | 3-205770 | 9/1991 |

* cited by examiner

*Primary Examiner*—Chandrika Prasad
(74) *Attorney, Agent, or Firm*—Gerald E. Hespos; Anthony J. Casella

(57) ABSTRACT

A connector has a housing (20) with cavities (21) and terminal fittings (10) insertable in the cavities (21). Each terminal fitting (10) has a lock engaging projection (17) for engaging a lock (22) of the housing (20). Each terminal fitting (10) also has a step (14) and a retainer engaging projection (15) formed continuously with the step (14). The lock engaging projection (17) interferes with a lock (46) of a retainer (40) that is being displaced to a full locking position even if the female terminal fitting (10) is left lightly inserted without reaching the position where the retainer engaging projection (15) interferes with the locking projection (46). Thus, an insufficient insertion can be detected even when the female terminal fitting (10) is left even more lightly inserted.

12 Claims, 10 Drawing Sheets

CONNECTOR WITH A SIDE RETAINER

BACKGROUND OF THE INVENTION

1. Field of the Invention

The invention relates to a connector provided with a side retainer.

2. Description of the Related Art

A side-retainer type connector is disclosed in U.S. Pat. No. 5,203,722 and also is shown in FIGS. 20 and 21 herein. This connector has a plurality of cavities 1 formed in a housing 2. A retainer 3 is inserted into the housing 2 in a direction normal to the cavities 1 and can be held at a partial locking position, as shown in FIG. 20, or a full locking position, as shown in FIG. 21. Terminal fittings 4 can be inserted into the cavities 1 when the retainer 3 is at the partial locking position and are partly locked by locks 5 of the housing 2 upon reaching proper positions. The retainer 3 then is pushed to a full locking position and locks 3A of the retainer 3 engage steps 6A at the rear edges of rectangular tubes 6 of the terminal fittings 4. As a result, the terminal fittings 4 are locked doubly. A terminal fitting 4 may be inserted insufficiently. In this situation, displacement of the retainer 3 to the full locking position is hindered by contact of the lock 3A with the rectangular tube 6. Therefore, an operator can detect insufficient insertion of the terminal fitting 4.

Some terminal fittings are small and steps at the rear end of the rectangular tube are not sufficiently strong for engagement by the side-retainer. Thus, a retainer engaging projection is formed at the rear of the rectangular tube for engagement by the lock of the retainer. The retainer will engage a side of a terminal fitting that is inserted insufficiently and the retainer will be unable to move to the full locking position. Consequently, an insufficient insertion can be detected.

Terminal fittings may be left only lightly inserted and the retainer engaging projections and the locking projections will not interfere with each other. Thus, the retainer may be displaced to or near the full locking position if pushed strongly, and there is a possibility of not properly detecting the insufficient insertion of the terminal fitting.

In view of the above problem, an object of the present invention is to provide a connector that can detect an insufficient insertion of a terminal fitting even if the terminal fitting is left at a lightly inserted position.

SUMMARY OF THE INVENTION

The invention is directed to a connector with a housing that has cavities for receiving terminal fittings and partial locking means for locking the terminal fittings. A retainer is mountable in the housing and is displaceable between a partial locking position and a full locking position. Partial locking means and/or full locking means may be provided for locking the retainer in the partial locking position and/or the full locking position, respectively. The terminal fittings are insertable into the cavities when the retainer is at the partial locking position. However, the retainer engages projections on the terminal fittings that have been inserted to their proper positions in the cavities when the retainer is at the full locking position to lock the terminal fittings in the respective cavities. Each terminal fitting comprises an insufficient-insertion detecting projection before or adjacent the retainer engaging projection and adapted to interfere with the retainer and to hinder a displacement of the retainer from the partial locking position to the full locking position when the terminal fitting is inserted insufficiently in the cavity. The retainer also may comprise at least one lock that can engage both a step and the retainer engaging projection of the terminal fitting.

The insufficient-insertion detecting projection interferes with the retainer while the retainer is being displaced to the full locking position even if the female terminal fitting does not reach the position where the retainer engaging projection interferes with the retainer. Thus, insufficient insertion can be detected even when the female terminal fitting is inserted only slightly.

The partial locking means preferably comprises resilient locks on the terminal fittings or the housing. The locks and the retainer preferably are on the same side of the cavities. Accordingly, dead space is avoided and the connector can be made smaller by narrowing the intervals of the cavities.

The retainer preferably comprises at least one jig insertion opening for allowing insertion of a jig to unlock the partial locking means when the retainer is in the partial locking position.

A sealing plug preferably is mountable in a chamber at the rear end of the housing. The sealing plug hermetically engages both the wires that extend into the housing and the inner surface of the chamber. However, the sealing plug conceals rear ends of the terminal fittings, and hence the terminal fittings are likely to be inserted insufficiently. Nevertheless, insufficient insertion can be detected by the insufficient-insertion detecting projections.

The housing may have a laterally aligned retainer insertion groove that communicates with the cavities. The insufficient-insertion detecting projection and/or the retainer engaging projection preferably are in the retainer insertion groove when the terminal fitting is inserted insufficiently.

The housing is formed with a groove that receives the insufficient-insertion detecting projection and/or the retainer engaging projection to stabilize the terminal fitting and to ensure proper insertion orientation.

A packing may be provided on the housing for sealing a connection of the connector with a mating connector. The packing may be held by the retainer so as not to come off the housing.

These and other objects, features and advantages of the present invention will become more apparent upon reading of the following detailed description of preferred embodiments and accompanying drawings. It should be understood that even though embodiments are described separately, single features thereof may be combined to additional embodiments.

DETAILED DESCRIPTION OF THE PREFERRED EMBODIMENTS

Figure 1:
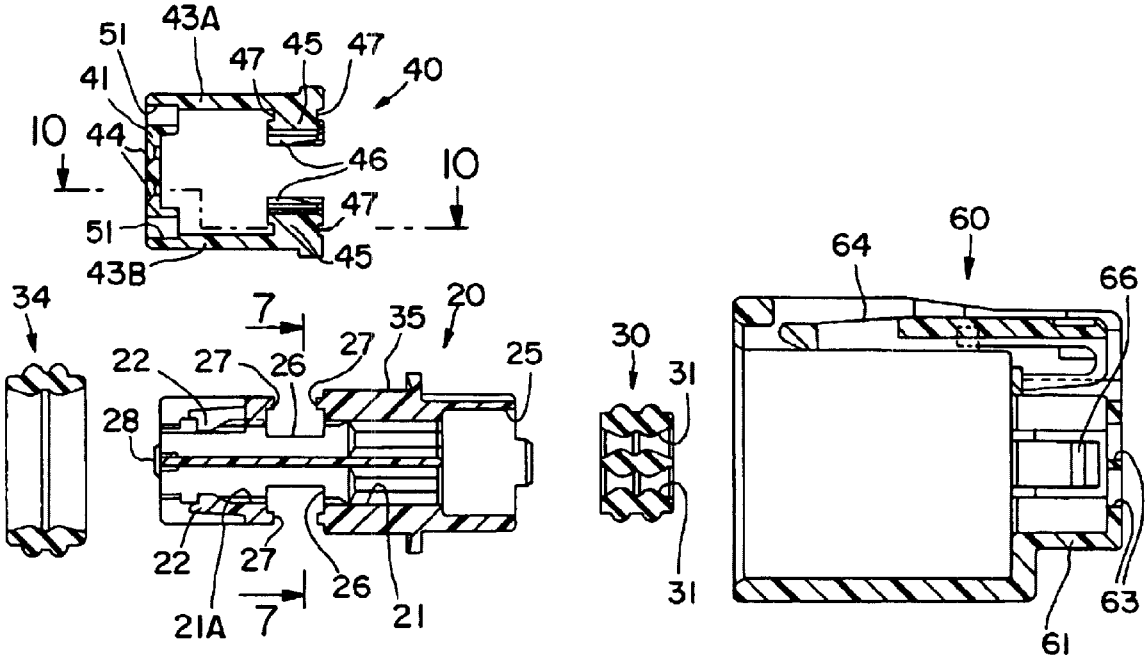
FIG. 1 is an exploded longitudinal section of a connector according to one embodiment of the invention.
Figure 2:
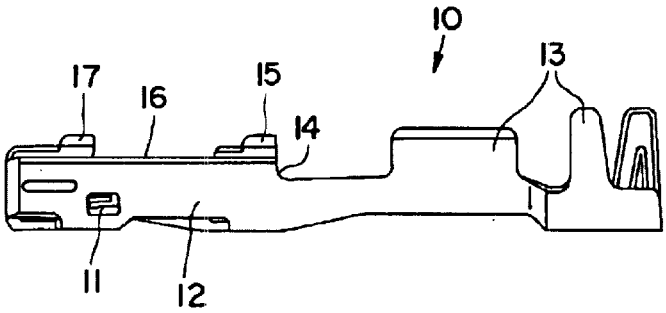
FIG. 2 is a side view of a formed female terminal fitting.
Figure 3:
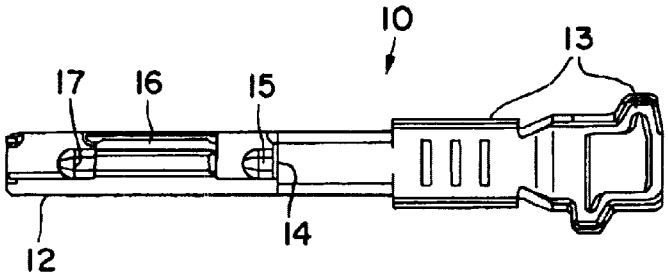
FIG. 3 is a plan view of the female terminal fitting.
Figure 4:
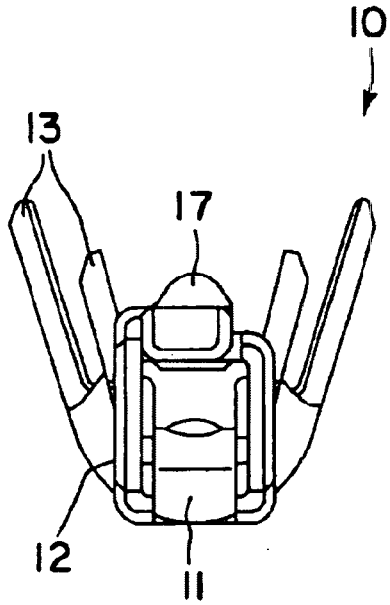
FIG. 4 is a front view of the female terminal fitting.

A female watertight connector in accordance with the invention includes female terminal fittings 10, as shown in FIGS. 2 to 4 and 12. Each female terminal fitting 10 is formed by bending, folding and/or embossing a piece of an electrically conductive metallic plate that has been stamped or cut out into a specified shape. The female terminal fitting 10 has a front end and a contact piece 11 folded rearwardly from the front end. A substantially rectangular tube 12 is formed adjacent the front end and around the contact piece 11. Thus, a tab (not shown) of a mating male terminal fitting can be accommodated inside the rectangular tube 12 for engaging the contact piece 11. Barrels 13 are formed at the rear end of the female terminal fitting 10 and can be crimped into connection with an end of a wire W. A step 14 is formed at the rear edge of the rectangular tube 12. The upper wall of the rectangular tube 12 partially has a double-wall structure, and a retainer engaging projection 15 is formed at the rear end of the upper wall substantially continuous with the step 14. A lock permitting recess 16 is formed substantially in the middle of the upper surface of the rectangular tube 12 with respect to forward and backward directions, and a lock engaging projection 17 having substantially the same shape as the retainer engaging projection 15 is formed before the recess 16.

Figure 5:
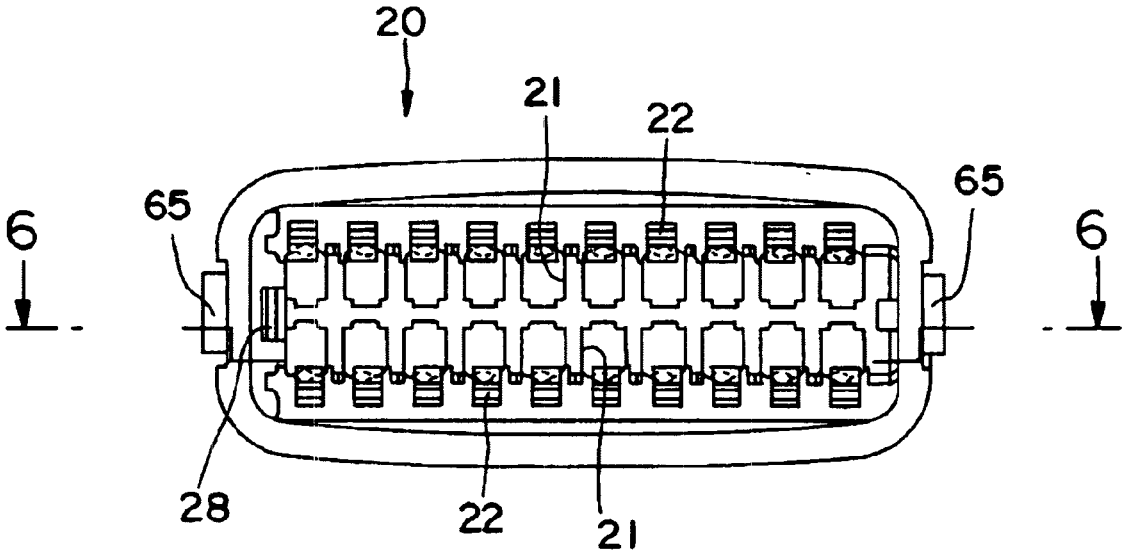
FIG. 5 is a front view of a housing.
Figure 6:
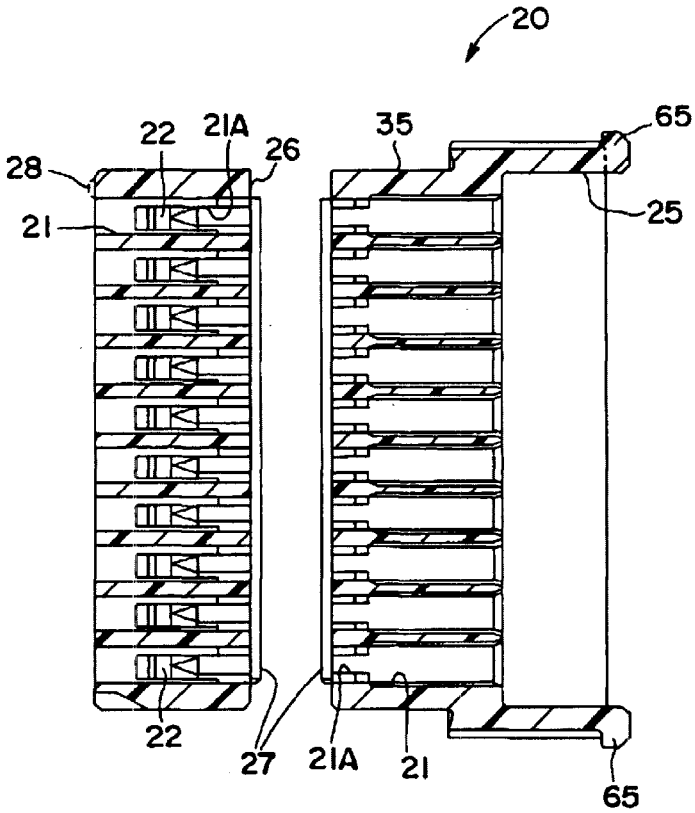
FIG. 6 is a cross-sectional view of the housing taken along lines 6—6 in FIG. 5.
Figure 7:
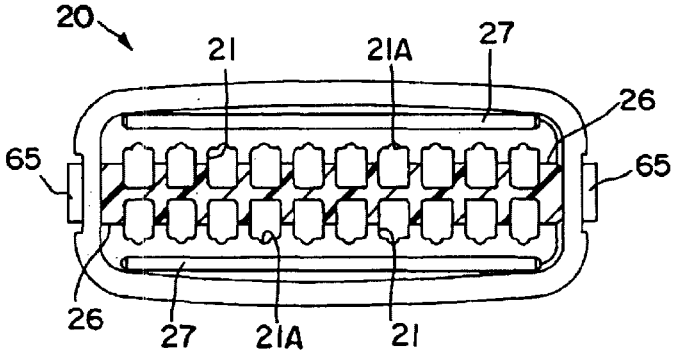
FIG. 7 is a cross-sectional view of the housing taken along line 7—7 in FIG.1.
Figure 8:
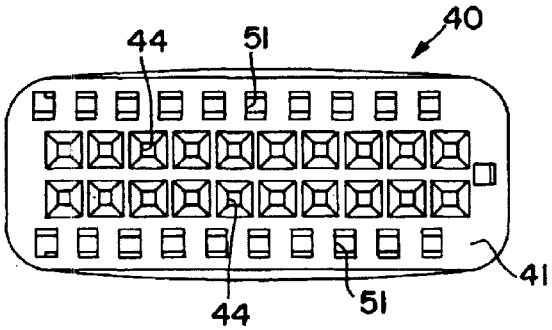
FIG. 8 is a front view of a retainer.
Figure 9:
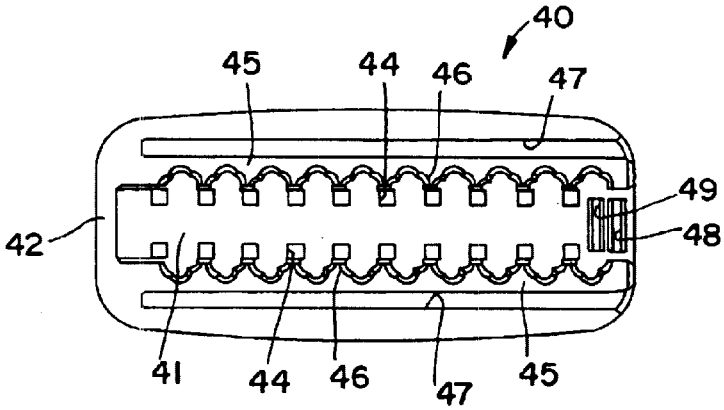
FIG. 9 is a rear view of the retainer.
Figure 10:
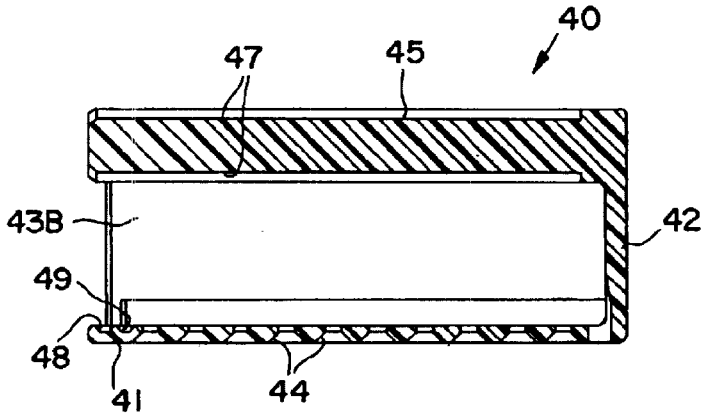
FIG. 10 is a cross-sectional view of the retainer taken along line 10—10 in FIG.1.

The female watertight connector includes a short blocked-shaped housing 20 made e.g. of a synthetic resin, as shown in FIGS. 1, 5 to 7. Ten juxtaposed cavities 21 extend longitudinally through the housing 20 at each of two upper and lower stages and are configured for accommodating the female terminal fittings 10. Of course, more or fewer cavities 21 may be provided in other embodiments. The upper and lower cavities 21 in each pair are formed symmetrically back-to-back. Locks 22 are provided on the ceiling surfaces of the upper cavities 21 and on the bottom surfaces of the lower cavities 21, and are resiliently deformable up or down away from the respective cavities 21, as shown in FIG. 1. A groove 21A is formed substantially at a widthwise center position on the surface of each cavity 21 where the lock 22 is formed as shown in FIG. 7, and the female terminal fitting 10 can be inserted in a stable orientation into the cavity 21 by causing the retainer engaging projection 15 and the locking-portion engaging projection 17 to enter the groove 21A. A plug cavity 25 is formed at the rear end of the housing 20 and communicates with rear entrances to the cavities 21.

Retainer insertion grooves 26 extend from one side surface of the housing 20 to the other, as shown in FIGS. 1, 6 and 7, and extend sufficiently into the upper and bottom surfaces of the housing 20 to communicate with the respective cavities 21. Additionally, the retainer insertion grooves 26 are located behind the locks 22. Transverse ribs 27 are formed at the front and rear edges of the retainer insertion grooves 26. A lock projection 28 is formed at a left position on the front end surface of the housing 20 when viewed from the front as shown in FIGS. 5 and 6.

A thick rubber plug 30 is mounted in the plug cavity 25 and substantially covers the entrances of the cavities 21. Wire insertion holes 31 are formed in the rubber plug 30 at positions substantially aligned with the cavities 21 for receiving and hermetically sealing to the wires W.

Figure 12:
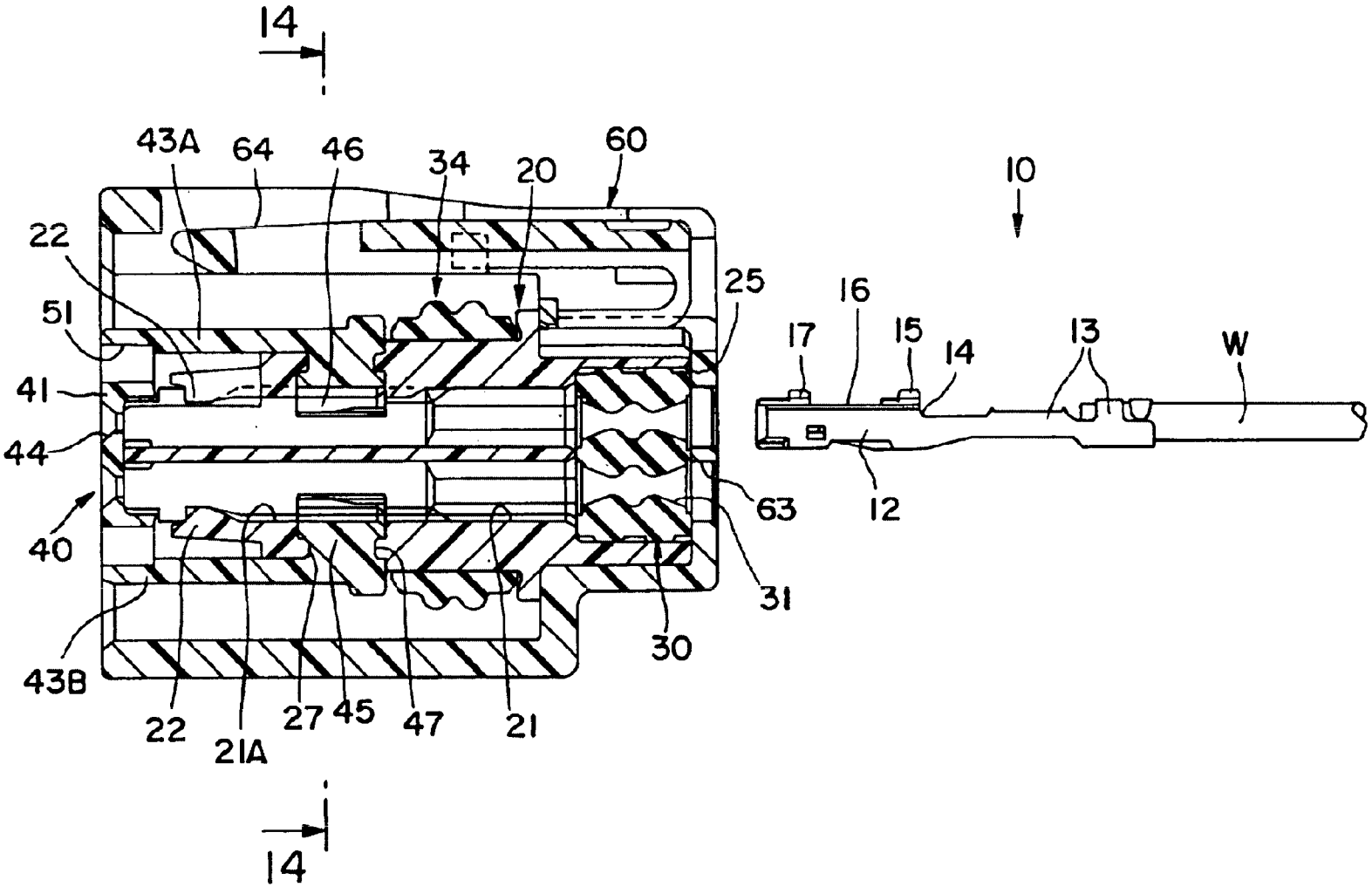
FIG. 12 is a at cross-sectional view taken along line 12—12 in FIG. 13 and showing the connector before the female terminal fitting is inserted.

Packing 34 is set at a mount position 35 on the outer surface of the housing 20 at a position slightly back from a middle position with respect to forward and backward directions. The packing 34 provides a seal between the mating male housing (not shown) and the housing 20. A retainer 40 is mounted forward of the mount position 35, as shown in FIG. 12. The retainer 40 is made e.g. of a synthetic resin and has a front-stop plate 41 for at least partly covering the front surface of the housing 20, a side plate 41 for covering the right lateral surface of the housing 20 when viewed from the front, an upper plate 43A and a bottom plate 43B for covering the upper and bottom surfaces of the housing 20, as shown in FIGS. 1, 8 to 10. The front-stop plate 41 stops the female terminal fittings 10 at front limit positions in the cavities 21 and has terminal insertion openings 44 through which the tabs of the male terminal fittings are insertable for mating with the female terminal fittings 10 in the cavities 21. The front-stop plate 41 also has jig insertion openings 51 through which a jig is insertable to unlock the lock 22. The jig insertion openings 51 are at upper left sides of the terminal insertion openings 44 at the upper stage and lower left sides of the terminal insertion openings 44 at the lower stage.

Projecting walls 45 project toward each other at the rear ends of the upper and bottom plates 43A, 43B, and are insertable sideways into retainer insertion grooves 26 in the housing 20. Locks 46 project from the leading end surfaces of the projecting walls 45 at positions corresponding to the respective cavities 21. Each lock 46 is engageable with the step 14 and the retainer engaging projection 15 of the corresponding female terminal fitting 10. The length of the lock 46 in forward and backward directions is greater than the distance between the forward end of the retainer engaging projection 15 and the rear end of the lock engaging projection 17 of each female terminal fitting 10.

Transverse guide grooves 47 are formed on the front and rear surfaces of the projecting walls 45 of the retainer 40 for engagement with the ribs 27. Accordingly, the retainer 40 is mounted into the housing 20 from the right side surface of the housing 20, when viewed from the front, by moving the front-stop plate 41 along the front surface of the housing 20, inserting the ribs 27 along the guide grooves 47 and inserting the projecting walls 45 into the retainer insertion grooves 26.

A partial locking recess 48 and a full locking recess 49 are formed substantially side-by-side at the left end of the rear surface of the front-stop plate 41 of the retainer 40 when viewed from the front (see FIGS. 9 and 10), and are engageable with the locking projection 28.

Figure 13:
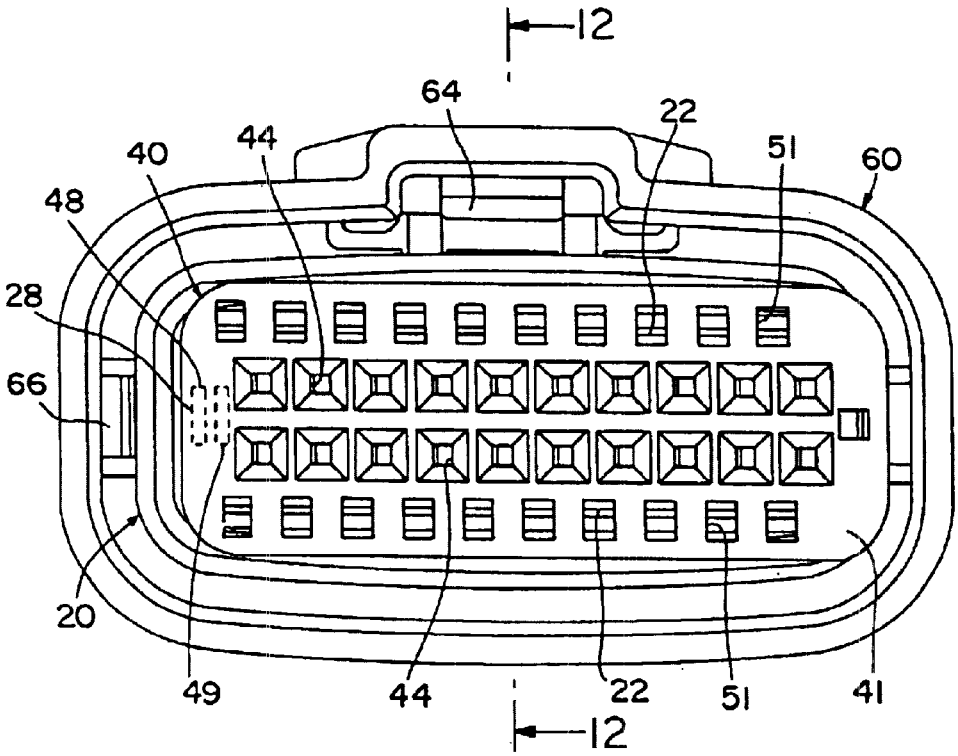
FIG. 13 is a front view of the connector when the retainer is at a partial locking position.
Figure 14:
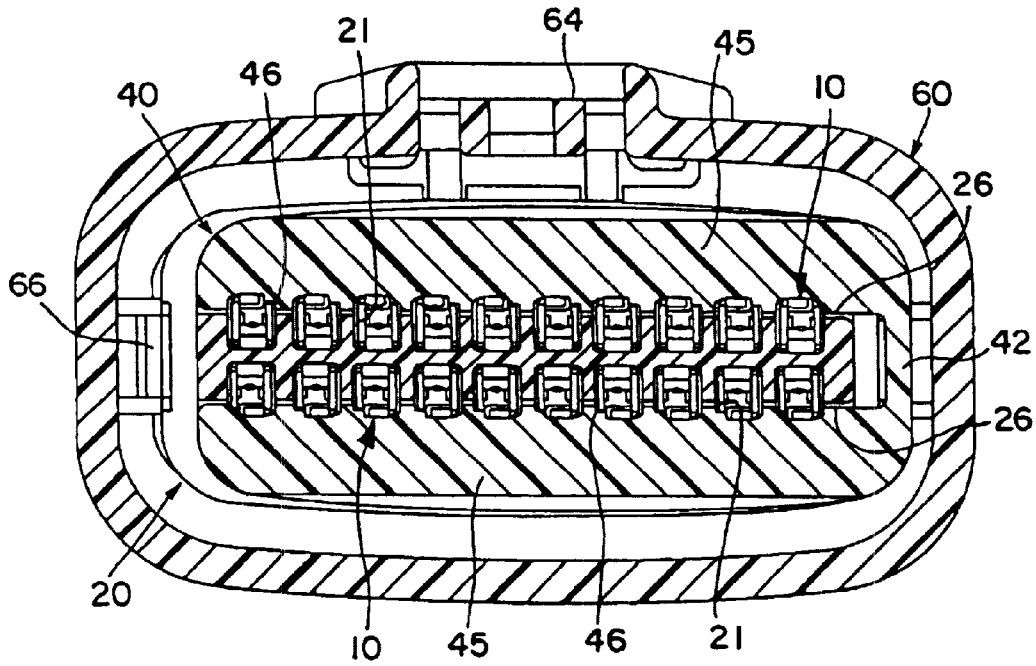
FIG. 14 is a cross-sectional view taken along line 14—14 in FIG. 12 and showing the connector when the retainer is at the partial locking position.

The projecting walls 45 of the retainer 40 are inserted into the retainer insertion grooves 26, and the lock projection 28 is fit into the partial locking recess 48 to hold the retainer 40 at a partial locking position (see FIGS. 13 and 14). Thus, the respective terminal insertion openings 44 of the front-stop plate 41 are displaced to the right to expose only right-side areas of the front surfaces of the corresponding cavities 21, as shown in FIGS. 13 and 14. Jig insertion openings 51 align with the front surfaces of the locks 22, so that a jig can be inserted through the jig insertion openings 51 to unlock the locks 22. Further, the respective locks 46 are located at the right side of the corresponding cavities 21.

Figure 16:
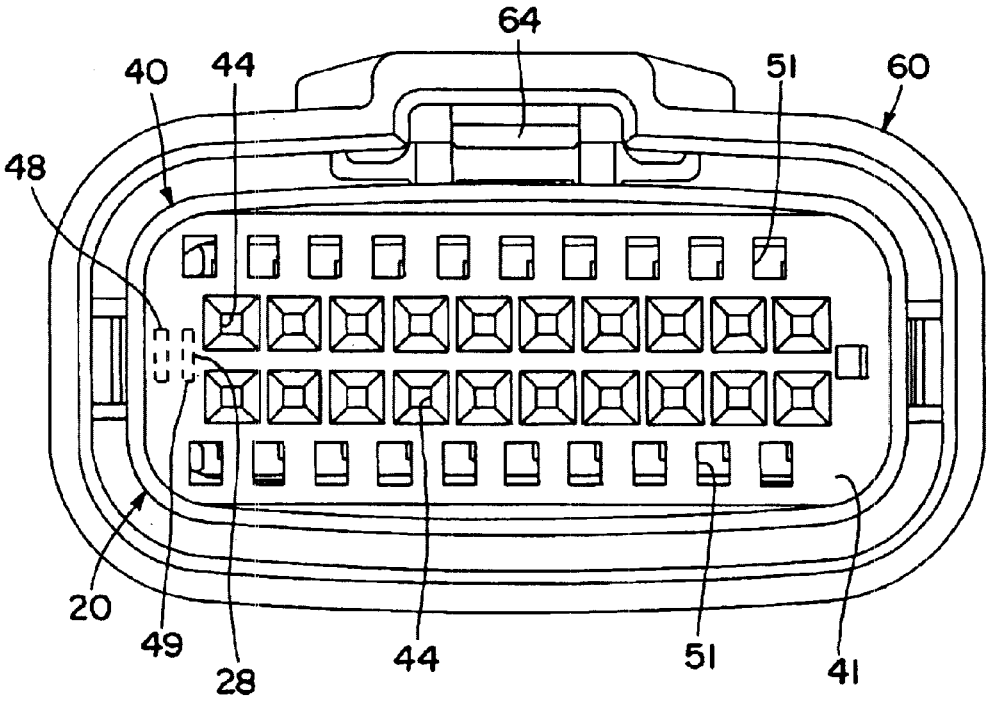
FIG. 16 is a front view of the connector when the retainer is at a full locking position.
Figure 17:
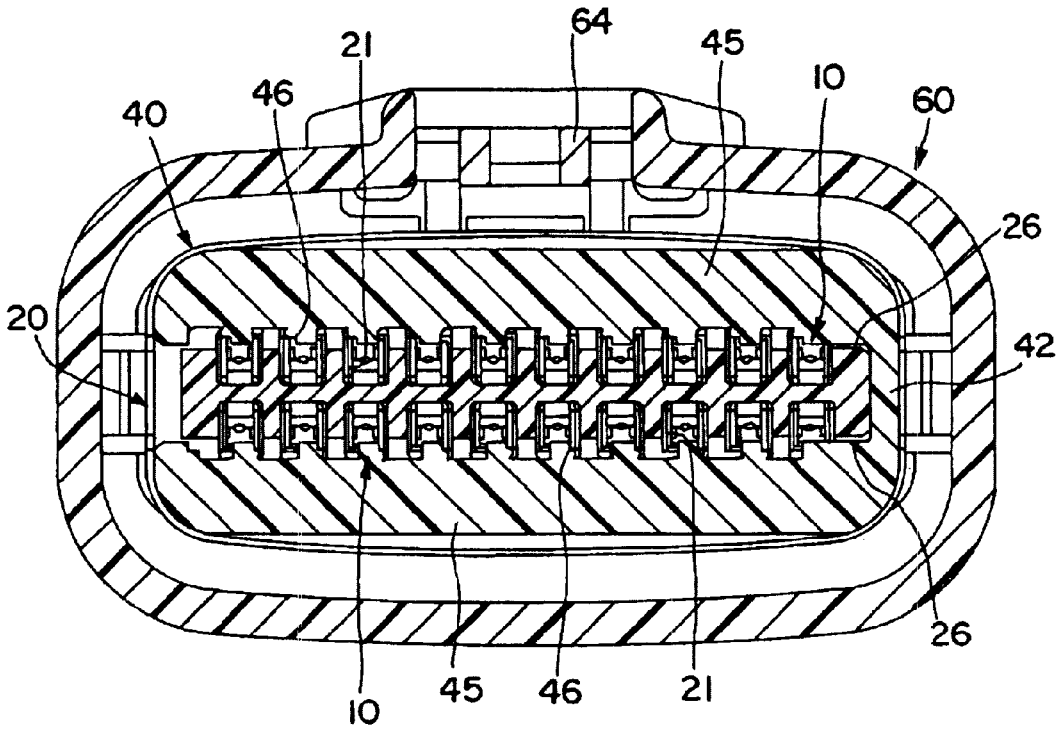
FIG. 17 is a cross-sectional view similar to FIG. 14, but showing the connector when the retainer is at the full locking position.

The retainer 40 can be pushed past the partial locking position, so that the lock projection 28 is fitted into the full locking recess 49 to hold the retainer 40 at a full locking position (see FIGS. 16 and 17). The terminal insertion openings 44 of the front-stop plate 41 align substantially with the corresponding cavities 21 and the locks 46 enter the corresponding cavities 21 when the retainer 40 is at the full locking position.

Figure 11:
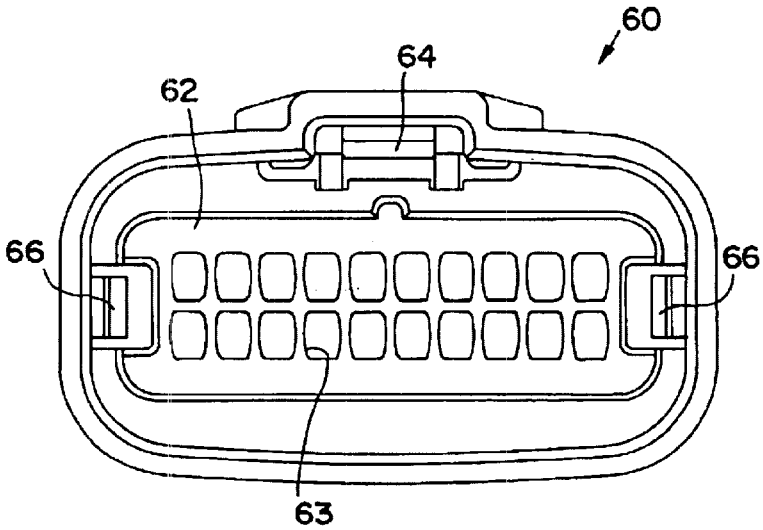
FIG. 11 is a front view of a receptacle.

A substantially rectangular tubular receptacle 60 also is made e.g. of a synthetic resin and substantially surrounds the housing 20, as shown in FIGS. 1 and 11. The receptacle 60 has a rear end with a smaller cross section into which the rear end of the housing 20 can be closely fit. A plug pressing member 62 is provided at the rear of the smaller section 61 and windows 63 are formed in pressing member 62 at positions substantially aligned with the cavities 21 for receiving the female terminal fittings 10.

A lock arm 64 is provided substantially at the widthwise center of the upper surface of the receptacle 60 for locking the housing 20 and the mating housing together.

Engaging projections 65 are at intermediate heights on the rear ends of the left and right surfaces of the housing 20. Rear surfaces of the engaging projections 65 are slanted.

Locking pieces 66 extend back at intermediate heights on the left and right surfaces of the smaller section 61 of the receptacle 60. The locking pieces 66 resiliently deform in transverse directions, and leading ends of the locking pieces 66 project into the smaller section 61. The engaging projections 65 are resiliently engageable with the leading ends of the locking pieces 66 when the housing 20 is fitted into the smaller section 61 until the rear surface of the housing 20 contacts the plug pressing member 62.

The connector is assembled by first mounting the packing 34 at the mount position 35 of the housing 20, and fitting the rubber plug 30 into the plug chamber 25. Thus, the outer surface of the rubber plug 30 is brought into close hermetic contact with the inner surface of the plug chamber 25.

The projecting walls 45 of the retainer 40 then are inserted into the upper and lower retainer insertion grooves 26 from the right side of the housing 20 when viewed from front until the retainer 40 is at the partial locking position. In this state, only the right parts of the cavities 21 are exposed by the respective terminal insertion openings 44 of the front-stop plate 41 of the retainer 40, and the locks 46 are at the right side of the corresponding cavities 21. Further, the retainer 40 prevents the packing 34 from coming off.

The housing 20 then is inserted from the front towards the rear end of the receptacle 60. The housing 20 is pushed until the rear end surface of the housing 20 contacts the plug pressing member 62 of the receptacle 60. This pushing causes the engaging projections 65 to deform the locking pieces 66 outward. The respective engaging projections 65 move over the leading ends of the locking pieces 66 to engage the locking pieces. Thus, the housing 20 and the receptacle 60 are assembled integrally into each other as shown in FIGS. 12 and 13. In this state, the connector can be transported to a terminal inserting location where the terminal fittings are inserted.

Figure 15:
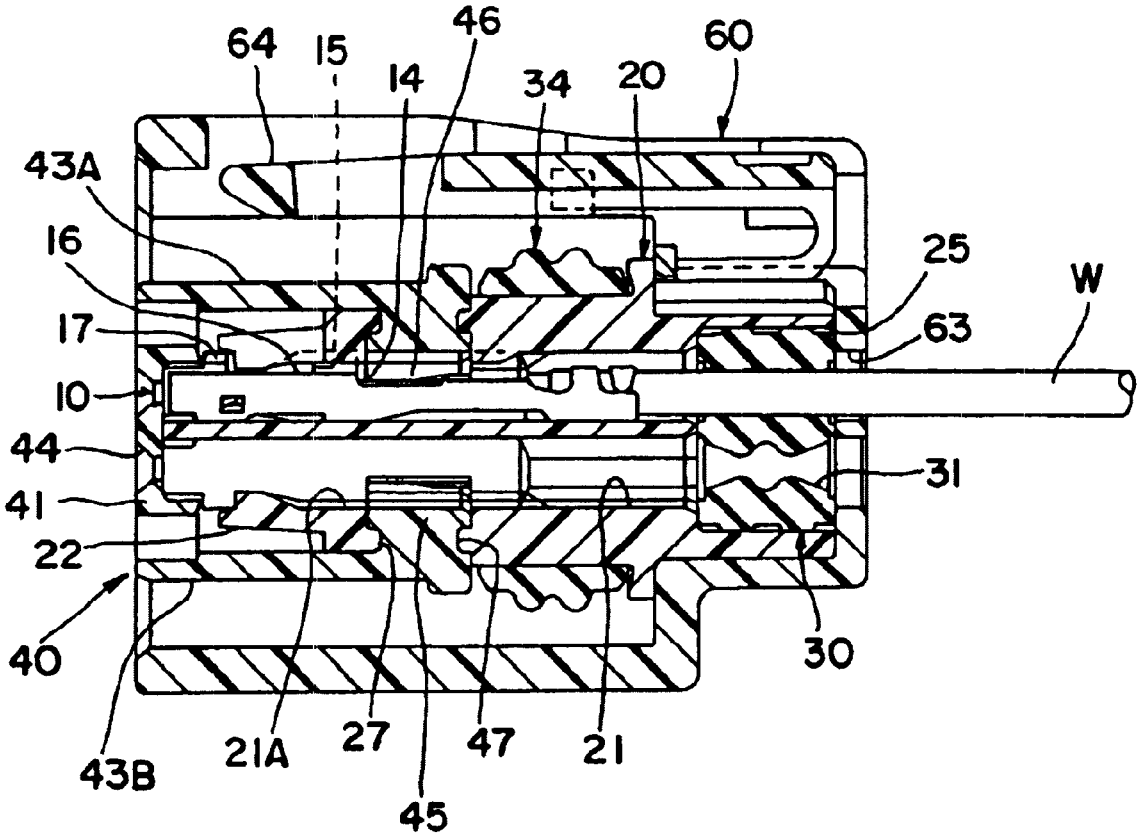
FIG. 15 is a cross-sectional view similar to FIG. 12, but showing a state where the female terminal fitting is inserted to a proper position.

The female terminal fittings 10 are inserted through the windows 63 of the plug pressing member 62, are pushed through and widen the corresponding insertion holes 31 of the rubber plug 30 and then enter into the corresponding cavities 21. The lock engaging projection 17 and the retainer engaging projection 15 successively enter into the groove 21A and stabilize the inserting orientation of the female terminal fitting 10. Additionally, the lock engaging projections 17 of the female terminal fittings 10 contact and deform the locks 22 as the female terminal fittings 10 are pushed into the cavities 21. The locks 22 are restored resiliently towards their original shape when the female terminal fittings 10 are inserted to a proper position. Thus, the locks 22 enter the recesses 16 and engage the lock engaging projection 17. As a result, the female terminal fitting 10 is locked so as not to come out (see FIG. 15). Further, the inner surface of the wire insertion hole 31 of the rubber plug 30 closely contacts the outer surface of the wire W inserted therethrough.

An electrical connection test is conducted when all the female terminal fittings 10 have been inserted into the cavities 21 to determine whether the female terminal fittings 10 have been inserted properly. This test is conducted by setting the connector in a testing device with the retainer 40 still left at the partial locking position. A test probe then is brought into contact with the female terminal fittings 10 through the terminal insertion openings 44 of the front-stop plate 41 of the retainer 40.

The connector is taken out of the testing device after the electrical connection test. Fingers then are placed on the front surface of the front-stop plate 41 of the retainer 40 in a state of FIG. 13, and the retainer 40 is moved to left in FIG. 13. Thus, the lock projection 28 moves into the full locking recess 49 to hold the retainer 40 at the full locking position as shown in FIG. 13.

The locks 46 of the retainer 40 enter the cavities 21 to engage the female terminal fittings 10 when the retainer 40 is moved to the full locking position. Thus, the female terminal fittings 10 are locked doubly. Importantly, the locks 46 of the retainer 40 engage both the steps 14 and the retainer engaging projections 15. Consequently, a total engaging area with the female terminal fittings 10 is large and, therefore, the female terminal fittings 10 are unlikely to come out of the cavities 21. Further, the terminal insertion openings 44 of the front-stop plate 41 align concentrically with the front entrances of the respective cavities 21.

In this way, the assembly of the female watertight connector is completed. The connector can be connected with a mating male connector so that the female and male terminal fittings are connected with each other. Additionally, the packing 34 is squeezed between the female housing 20 and the mating male housing to provide sealing between the two housings.

Figure 18:
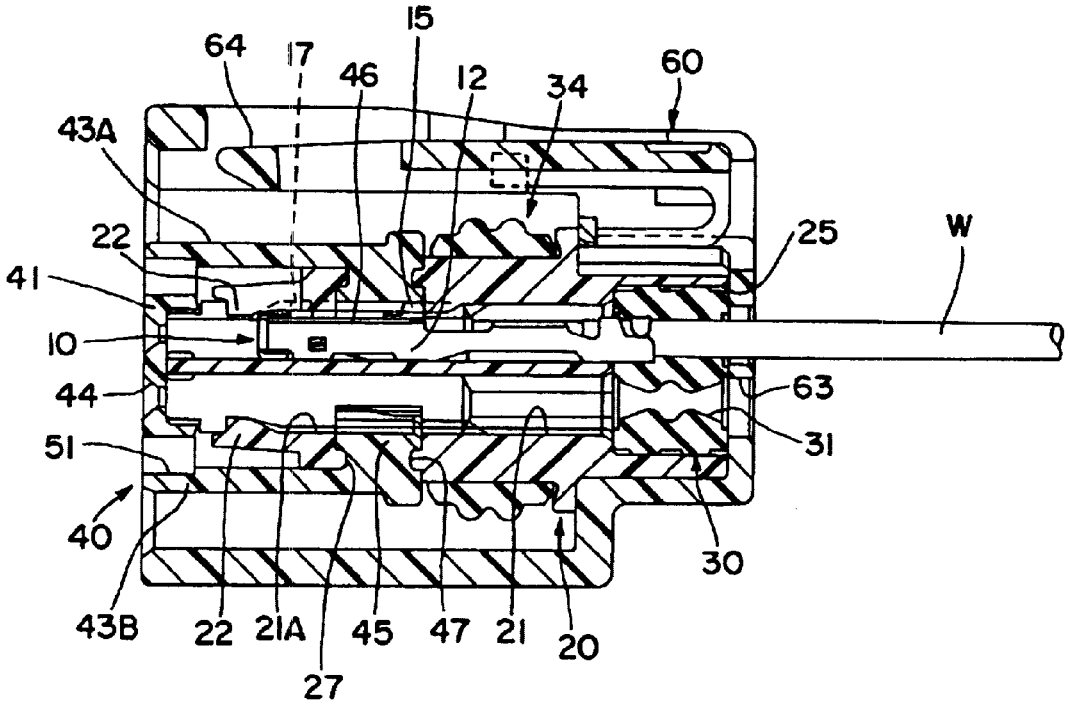
FIG. 18 is a cross-sectional view similar to FIG. 12, showing a state where the female terminal fitting is at a lightly inserted position before a proper position.

The rear ends of the female terminal fittings 10 are covered by the rubber plug 30 and cannot been seen. Thus, there is a possibility that the female terminal fittings 10 may be inserted insufficiently into the cavities 21, and hence an operator may unwittingly try to move the retainer 40 to the full locking position. FIG. 18 shows a state where the female terminal fitting 10 has not reached its proper position, and the retainer engaging projection 15 is located inside the retainer insertion groove 26. If the retainer 40 is moved towards the full locking position in this state, the retainer engaging projection 15 interferes with the lock 46 and hinders movement of the retainer 40. Thus, the insufficient insertion can be detected.

Figure 19:
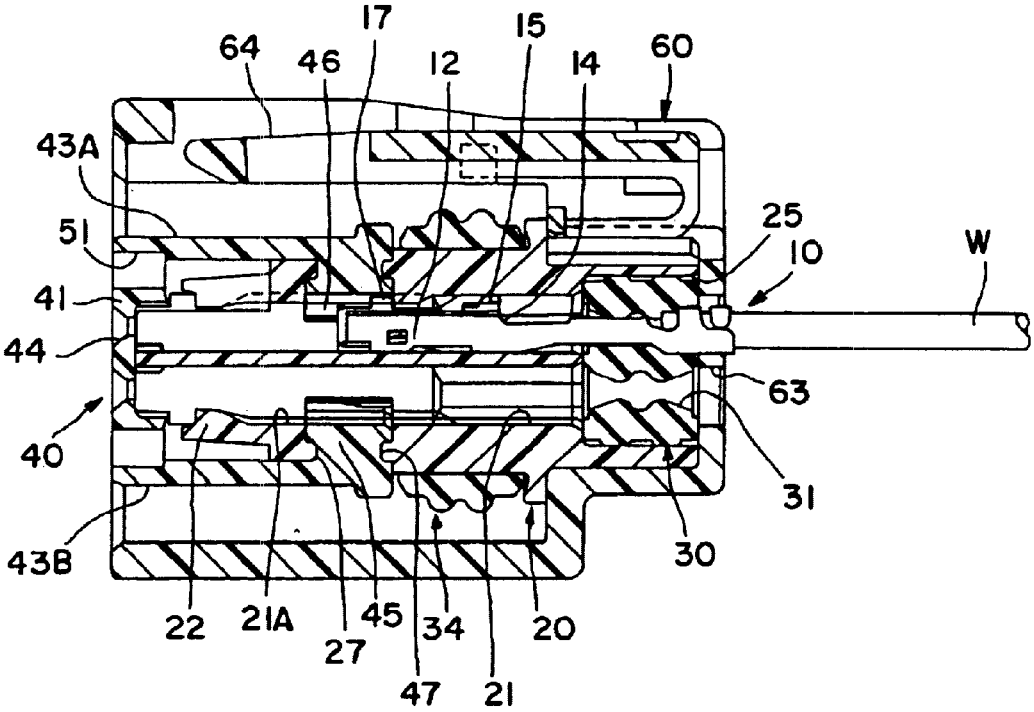
FIG. 19 is a cross-sectional view similar to FIG. 12, showing a state where the female terminal fitting is at an even more lightly inserted position.
Figure 20:
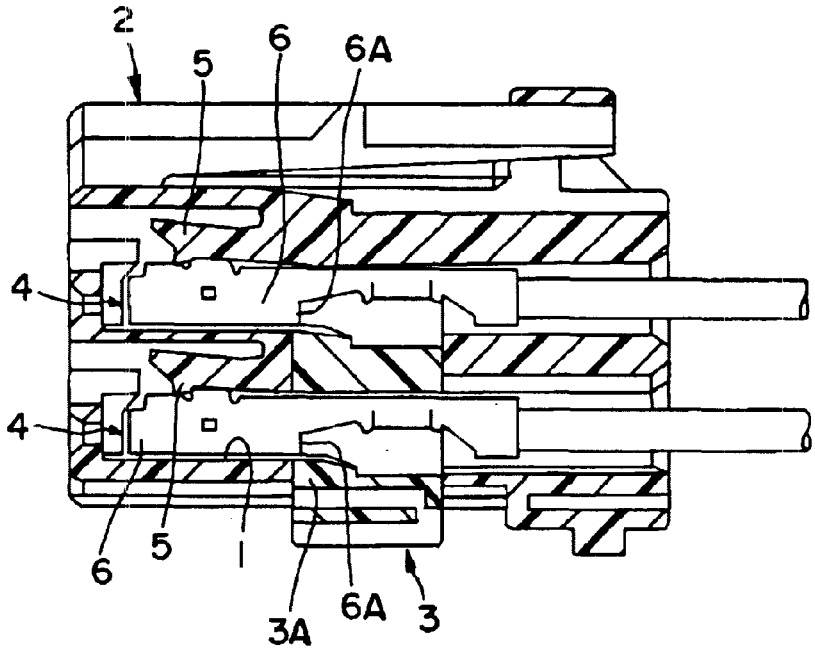
FIG. 20 PRIOR ART
FIG. 20 is a longitudinal section of a prior art connector when a retainer is at a partial locking position.
Figure 21:
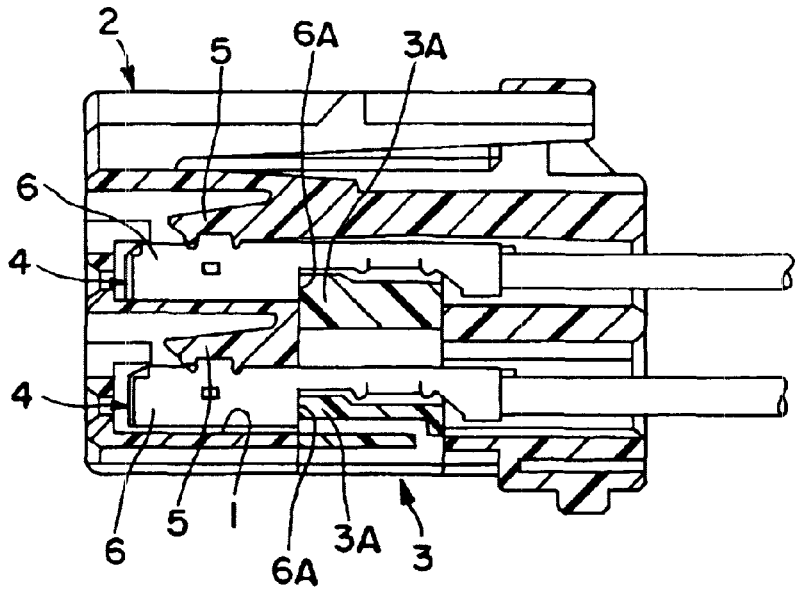
FIG. 21 PRIOR ART
FIG. 21 is a longitudinal section of the prior art connector when the retainer is at a full locking position.

FIG. 19 shows a state where the female terminal fitting 10 is inserted even less, and the lock engaging projection 17 is in the retainer insertion groove 26. If the retainer 40 is moved towards the full locking position in this state, the lock engaging projection 17 interferes with the lock 46 to hinder a movement of the retainer 40. Thus, the insufficient insertion can be detected.

As described above, the lock engaging projection 17 interferes with the lock 46 of the retainer 40 while the retainer 40 is displaced towards the full locking position, even if the female terminal fitting 10 has not reached the position where the retainer engaging projection 15 interferes with the lock 46. Thus, the insufficient insertion can be detected even when the female terminal fitting 10 is inserted only slightly.

The locks 22 and the locks 46 of the retainer 40 are at the same side in the cavities 21. Thus, dead space is not created and the connector can be made smaller by narrowing the intervals of the cavities 21. In addition, the connector can be simplified since the lock engaging projections 17 that engage the locks 22 also act as projections for detecting the insufficient insertion.

Furthermore, the rear ends of the terminal fittings 10 are concealed by the rubber plug 30, and cannot be seen. Thus, the terminal fittings are particularly likely to be left insufficiently inserted. However, the insufficient insertion can be detected by the lock engaging projections 17.

The present invention is not limited to the above described and illustrated embodiment. For example, the following embodiments are also embraced by the technical scope of the present invention as defined in the claims. Beside the following embodiments, various changes can be made without departing from the scope and spirit of the present invention as defined in the claims.

The present invention is also applicable to male connectors that accommodate male terminal fittings.

Although the housing 20 is provided with the locking portions 22 as the partial locking means in the foregoing embodiment, the terminal fittings may be provided with metal locks according to the present invention.

The continuous disposition of retainer engaging projections 15 and the steps 14 in the foregoing embodiment increases the engaging area of the retainer 40 with the terminal fittings 10. However, the retainer engaging projections 15 may be spaced from the steps according to the present invention.

The present invention is also applicable to nonwatertight connectors.

The present invention is also applicable to connectors having a gelatinous material to be pierced through by the terminal fittings 10 instead of the rubber plug 30.

What is claimed is:

1. A connector, comprising:

a housing formed with cavities;

terminal fittings configured for insertion into the cavities;

partial locking means for locking the terminal fittings in the cavities;

a retainer mountable into the connector housing and displaceable between a partial locking position where the insertion of the terminal fittings into the cavities is permitted and a full locking position where the retainer engages the terminal fittings inserted to proper positions in the cavities to lock the terminal fittings; and the terminal fittings each having a retainer engaging projection engageable with the retainer when the terminal fitting is at the proper position and an insufficient-insertion detecting projection disposed and configured to interfere with the retainer to hinder a displacement of the retainer from the partial locking position to the full locking position when the terminal fitting is insufficiently inserted to a position behind the proper position in the cavity.

2. The connector of claim 1, wherein the partial locking means comprises locks provided on one of the terminal fittings and the housing and resiliently engageable with the other thereof.

3. The connector of claim 2, wherein the retainer is at the same side in the cavities as the locks when the retainer is at the full locking position.

4. The connector of claim 1, wherein the retainer has jig insertion openings for insertion of a jig to unlock the partial locking means when the retainer is in the partial locking position.

5. The connector of claim 1, further comprising a sealing plug mounted in and sealed with a sealing plug chamber in a rear end of the housing, the sealing plug being configured for hermetic sealed engagement with wires (W) extending from the housing.

6. The connector of claim 5, wherein the sealing plug is a one-piece rubber plug.

7. The connector of claim 1, wherein each said cavity has a groove the insufficient-insertion detecting projection and the retainer engaging projection being received in the respective groove for orienting the respective terminal fitting in the connector housing.

8. The connector of claim 1, wherein the connector housing is provided with a retainer insertion groove extending substantially laterally and communicating with the cavities.

9. The connector of claim 8, wherein the insufficient-insertion detecting projection and the retainer engaging projection are positioned in the retainer insertion groove when the terminal fitting is inserted insufficiently.

10. The connector of claim 1, wherein the retainer comprises locks disposed for engaging both steps and the retainer engaging projections of the terminal fittings.

11. The connector of claim 1, wherein the partial locking means and full locking means are provided for locking the retainer in the partial locking position and the full locking position respectively.

12. The connector of claim 1, wherein a packing is provided on the housing for sealing a connection of the connector with a mating connector, wherein the packing is held by the retainer so as not to come off the housing.

* * * * *